United States Patent [19]

Ambasz

[11] 3,982,785

[45] Sept. 28, 1976

[54] CHAIR

[75] Inventor: Emilio Ambasz, New York, N.Y.

[73] Assignee: Center for Design Research and Development, Willemstad, Netherlands Antilles

[22] Filed: July 29, 1974

[21] Appl. No.: 492,693

[52] U.S. Cl. ..... 297/160; 297/239; 297/248; 297/337; 297/440

[51] Int. Cl.[2] ..... A47B 39/00; A47C 7/00

[58] Field of Search ..... 297/160, 161, 162, 337, 297/291, 292, 317, 335, 332, 440, 239, 445, 248

[56] References Cited

UNITED STATES PATENTS

| | | | |
|---|---|---|---|
| 704,109 | 7/1902 | Richards | 297/291 |
| 1,435,741 | 11/1922 | Sadler | 297/292 |
| 1,712,727 | 5/1929 | Birdsall | 297/337 |
| 3,497,262 | 2/1970 | Piretti | 297/248 |
| 3,567,280 | 3/1971 | Bradshaw | 297/318 |
| 3,610,686 | 10/1971 | Caruso | 297/248 |
| 3,638,998 | 2/1972 | Anderson | 297/332 |
| 3,677,601 | 7/1972 | Morrison | 297/248 |
| 3,705,744 | 12/1972 | Piretti | 297/335 |

FOREIGN PATENTS OR APPLICATIONS

| | | | |
|---|---|---|---|
| 475,455 | 10/1952 | Italy | 297/291 |
| 174,446 | 1/1922 | United Kingdom | 297/332 |

*Primary Examiner*—James T. McCall
*Attorney, Agent, or Firm*—Brumbaugh, Graves, Donohue & Raymond

[57] ABSTRACT

A chair has a seat that moves forward and backward with respect to its support, preferably in such a way that the front end is elevated somewhat as the seat moves forward, and a back that pivots between a substantially upright and an inclined position, depending upon the posture assumed by one sitting in the chair. The chair is of modular construction and embodies various parts, such as legs, back supports, arm rests and writing surfaces, that are interchangeable or can be added on or left off. Modular fittings are provided to join two or more chairs together.

26 Claims, 37 Drawing Figures

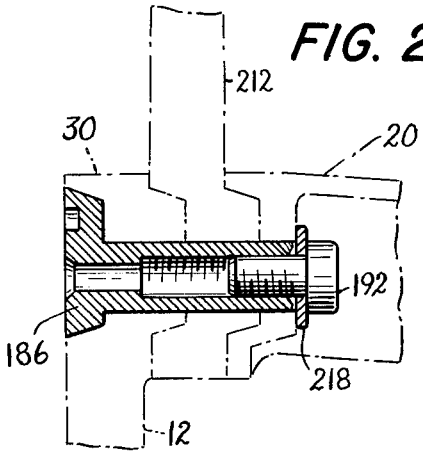
FIG. 24
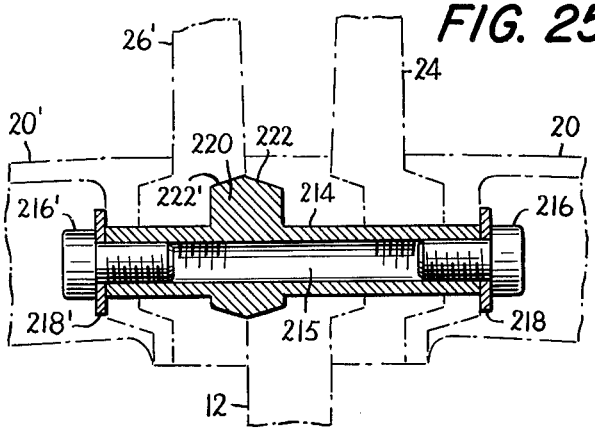
FIG. 25
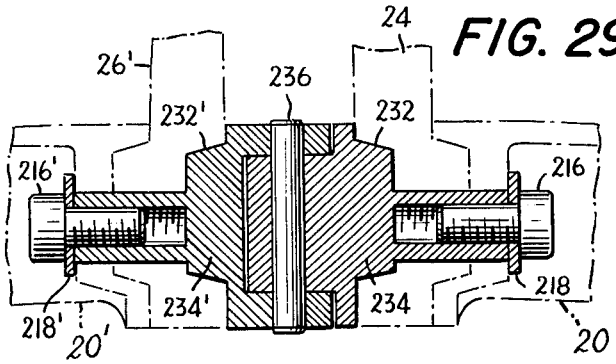
FIG. 29
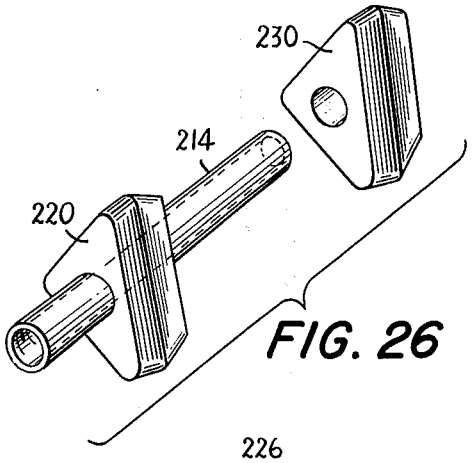
FIG. 26
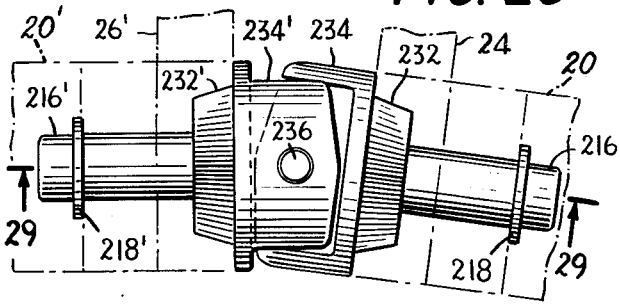
FIG. 28
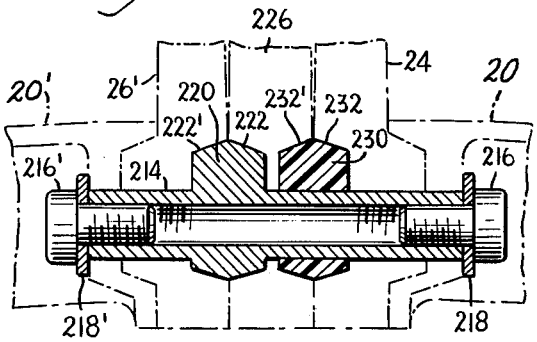
FIG. 27
FIG. 22
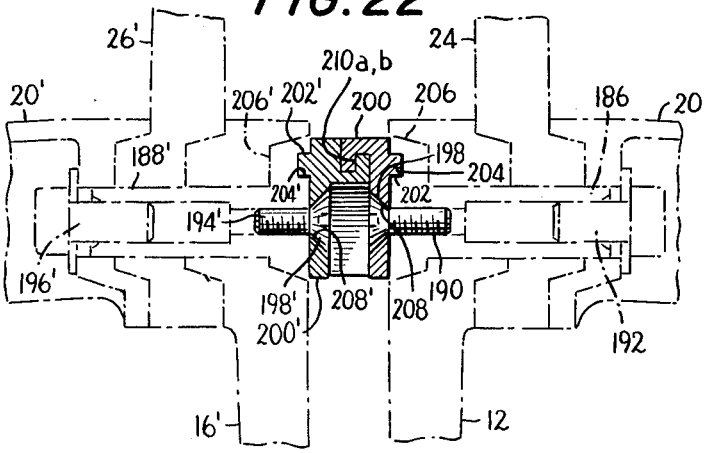
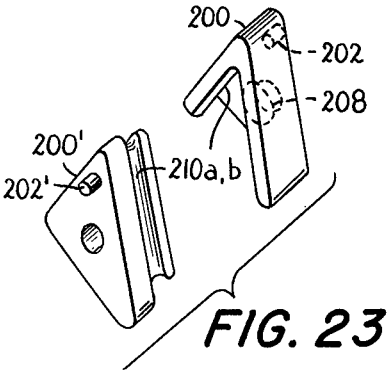
FIG. 23

CHAIR

BACKGROUND OF THE INVENTION

This invention relates to chairs and, in particular, to attractive, durable chairs intended for mass production and institutional use in a variety of specific configurations.

Conventional chairs intended for mass production and institutional use are the result of compromise. The size, the rake of the seat, and the slope of the back are presumably selected with regard to persons of average height, weight, build and personal preference. Once installed, in a theater, for example, the same chair successively accommodates a large number of people of widely different physical and psychological make-up and is bound to be less than ideal for many of them.

The design of conventional chairs is generally a compromise in the further respect that it is based on meeting a specific end-use objective; for example, a chair may have a writing arm, the design objective being a chair for use in classrooms, or it may have ordinary arm rests or no arm rests, depending on the purpose. The same basic design often serves limited purposes, so that each purpose necessitates a separate design.

SUMMARY OF THE INVENTION

The invention is intended to remedy the limitations of conventional chair designs, such as those described above and, in particular, to provide chairs suitable for mass production and for institutional use and having features that make them unusually comfortable, attractive, inexpensive, easy to assemble, utilitarian and adaptable to construction in a wide variety of configurations by interchaning a relatively small number of parts.

One aspect of the invention is concerned with providing a chair that has a movable seat and pivotable back so that one sitting in the chair can, upon assuming various sitting postures, alter the configuration of the chair for optimum comfort. According to such aspect of the invention, the chair comprises a seat that is mounted, on a seat support for movement between rearward and forward positions, preferably for progressive change in orientation or rake in accordance with the extend of rearward and forward movement, the change in rake involving increasing elevation of the front end relative to the rear end of the seat, the nearer the seat is to its forwardmost position. The back of the chair is mounted so that it pivots between a substantially upright position and an inclined position, thereby affording maximum comfort to the back of the person sitting in the chair for all positions of the seat relative to the back. The movable seat and back are shifted in orientation independently of each other, but both the seat and back are arranged to be shifted in orientation to conform to a virtually infinite range of sitting postures assumed by the wide variety of persons using the chair. For example, one may choose to sit erect in the chair, in which case the back will tend to pivot under the pressure of the back of the user into an upright position, and the seat will normally shift to its rearward position in which it is oriented substantially horizontally. At the other extreme, one may choose to slump back in the chair, in which case the seat will shift forward, such shifting automatically occurring as the person changes position from erect to slumped, and the seat will reside in an inclined position with the front end higher than the rear end so that the tendency for the person to slide off the seat will be minimized and the seat will be comfortable in the slumped position. At the same time, the back will pivot into an inclined position in conformity with the slumped posture of the person sitting in the chair.

Another aspect of the invention relates to the manufacture of chairs in a wide variety of configurations at relatively low cost and with considerable ease of assembly based on a modular concept employing a relatively small number of interchangeable parts. The modular concept, according to this aspect of the invention, involves a seat module, a back module, a variety of back supports, a variety of legs and pedestals, a selection of arm rests which may be part of or separate from the back supports and any of a number of accessory components such as writing tables, fittings that enable the chairs to be permanently or temporarily connected side-by-side (i.e., ganged or stacked), and a small number of fasteners that are suited to connecting the modular parts in the variety of configurations.

An important part of the seat module is a seat support which includes a member extending transversely under the seat and which has on each side a connector portion having a key-type formation. Each of the back supports, various types of leg members, arm rests and writing tables has a connector portion that includes a first key-type formation that is complementary to the formation on the connector portion of the seat support and is interengageable with the seat support connector portion rigidly to position an arm rest, leg, back support, writing table or the like to the connector portion of the seat support. The connector portion of each arm rest, leg, back support and the like also includes a second key-type formation that matches the key-type fomation on each connector portion of the seat support, the second key-type formation thus being capable of receiving in interengagement the first key-type formation of any one of the back support, arm rest, leg and writing table modules of the chair for rigid positioning. Thus, the various back supports, arm rests, legs, writing tables and any other modular components can be secured side-by-side at each end of the seat support and are rigidly positioned by engagement of the respective key-type formations on the connector portions, and a chair manufacturer, or even a user, can readily assemble a chair of a desired configuration by selecting back support, leg, arm rest, writing table and other modular elements of the chair and fastening them in any desired order to the connector portions at each end of the seat support. The modular approach embodied in a chair, according to the present invention, thus permits a manufacturer to make a limited number of chair components and to assemble them on a selected basis in a wide variety of configurations.

A number of modular components of the chair embody novel aspects. For example, a writing table module having a table component with an integral arm rest and mounted on a support for pivoting between a position in which the table hangs down at the side of the seat and the arm rest is in a position for use and a position in which the writing table lies horizontally in front of the seat for use is a highly useful modular element for various types of meeting and lecture rooms in schools and offices. The seat and back modules may consist of a structural member and a decorative snap-on cover or it may be made of a unitary molded rigid foamed polymeric material. Various forms of arm rests may be composed of a structural element having a multiplicity of closely spaced holes and a plastic insert having pins that project up through the holes and above the supporting surface of the structural member, the plastic insert being color-coordinated to the seat in back and providing a non-slip characteristic to the arm rest.

DESCRIPTION OF THE DRAWINGS

A better understanding of the invention can be gained from the following description of a number of representative embodiments thereof, considered in conjuction with the figures of the accompanying drawings, in which:

FIG. 22 is a front sectional view in a vertical plane showing in detail the mechanism for joining two chairs as illustrated in FIG. 7;

FIG. 23 is an exploded perspective view of a portion of the structure shown in FIG. 22;

FIG. 24 is a front sectional view in a vertical plane of a portion of the structure of FIG. 9;

FIG. 25 is a front sectional view in a vertical plane of a portion of the structure of FIG. 12;

FIG. 26 is an exploded perspective view of a portion of the structure of FIG. 27;

FIG. 27 is a front sectional view in a vertical plane of a portion of the structure of FIG. 16;

FIG. 28 is a top plan view showing in greater detail a portion of the structure of FIG. 17;

FIG. 29 is a sectional view along the line 29—29 of FIG. 28;

DESCRIPTION OF THE PREFERRED EMBODIMENTS

Figure 1:
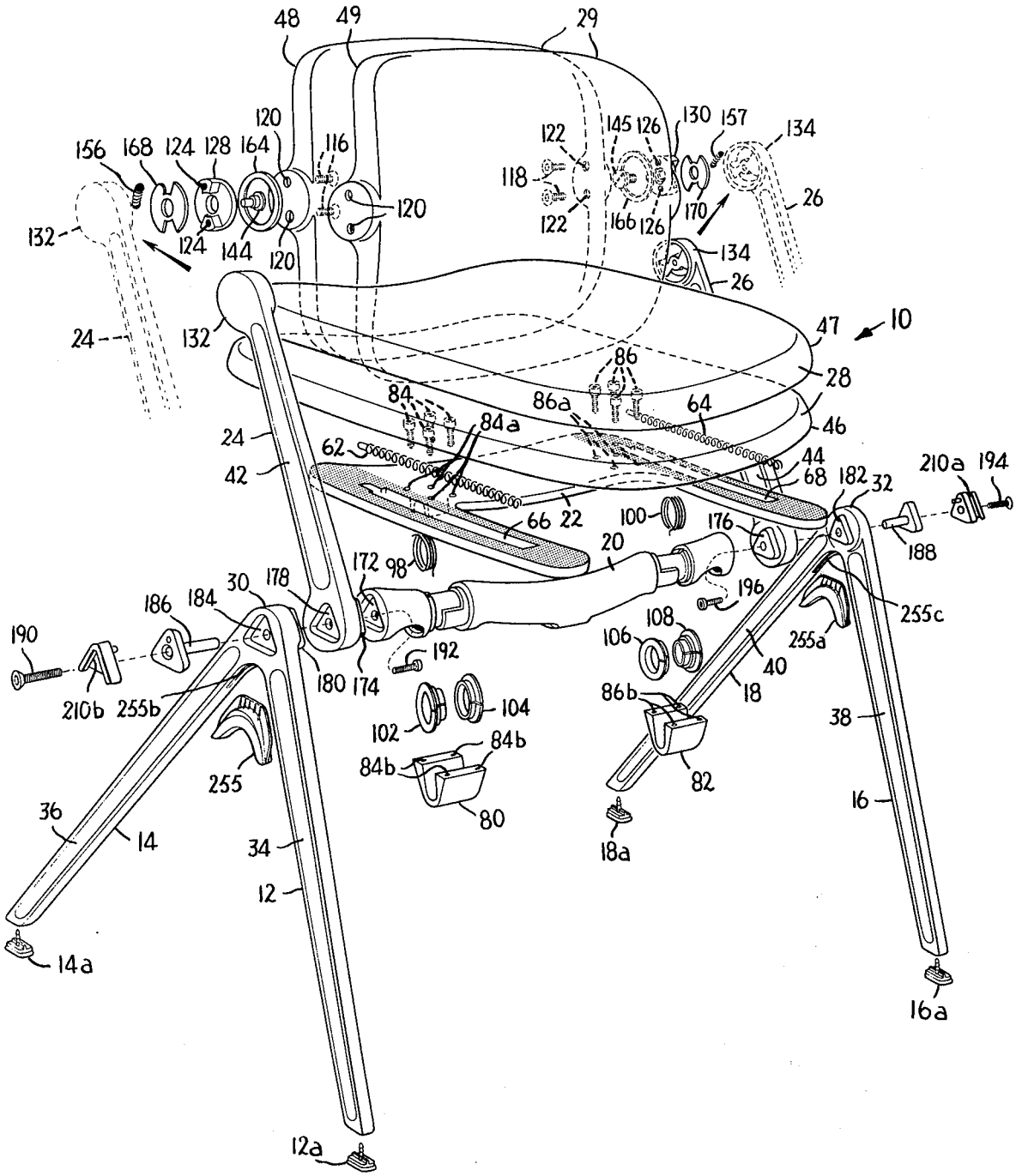
FIG. 1 is an exploded perspective view of a representative embodiment of a chair according to the invention.
Figure 2:
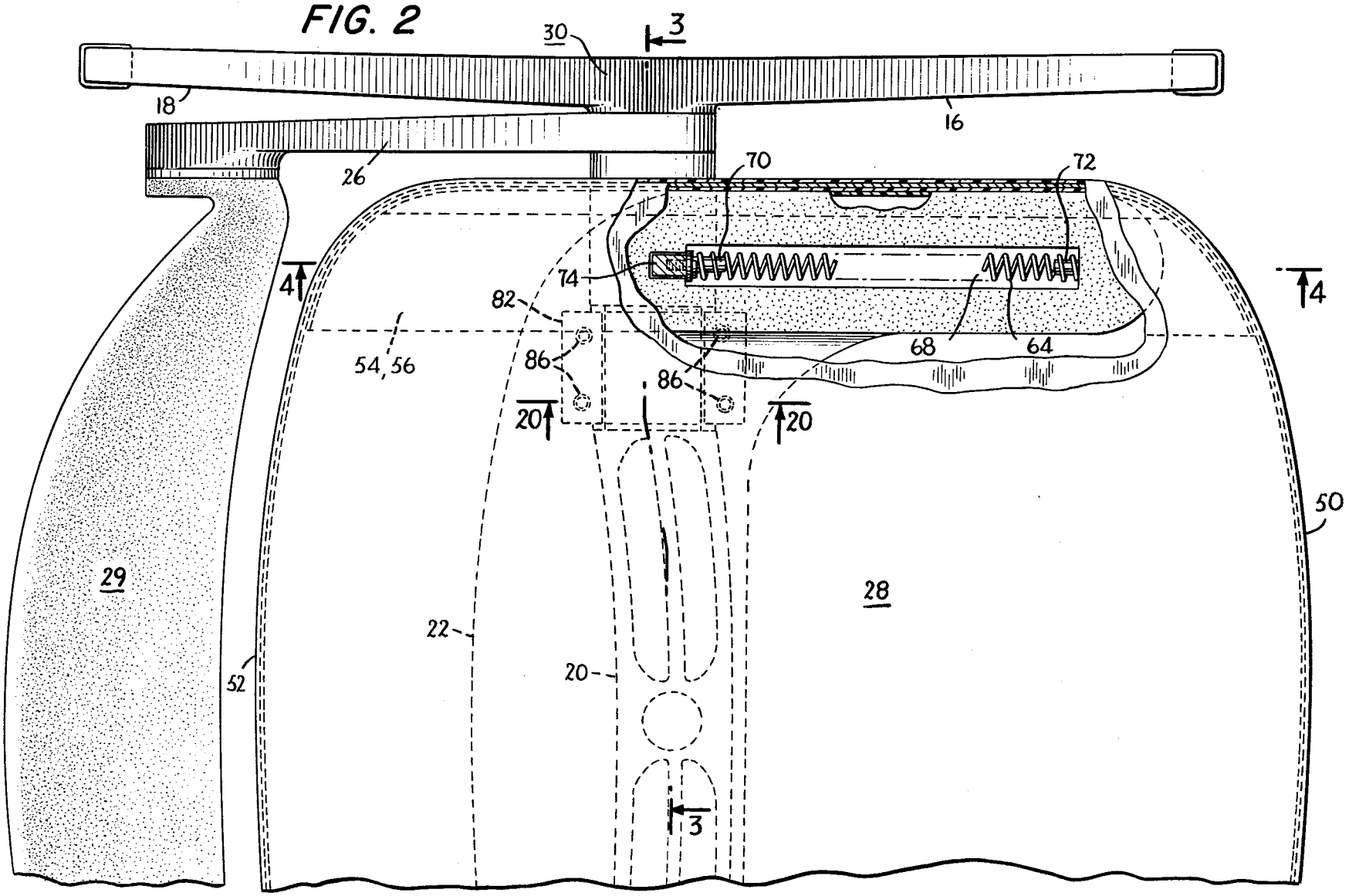
FIG. 2 is a fragmentary top plan view of the left side of the chair shown in FIG. 1, a part being borken away to reveal certain structure otherwise hidden.

FIG. 1 shows a representative embodiment of a chair 10 constructed in accordance with the invention. It comprises right front and rear and left front and rear legs 12, 14, 16, 18, having non-slip rubber feet **12*a*, 14*a*, 16*a*, 18*a*, respectively, seat-support means comprising a cross brace 20 and a guide frame 22 secured thereto, back-support means 24, 26, a seat 28, and a back 29**.

The legs 12, 14 and 16, 18 meet at junctions 30, 32, respectively, so that the right legs 12, 14 and left legs 16, 18 form rigid, inverted V-shaped structures. To save weight while ensuring ample strength, the legs have channels formed therein on either side, of which channels 34, 36, 38, 40 are visible in FIG. 1.

Each member 24, 26 of the back-support means is also formed with channels on either side. These four, of which channels 42, 44 are visible in FIG. 1, are similar to the leg channels 34, 36, 38, 40 and also for the purpose of saving weight while ensuring ample strength.

The seat 28 comprises a structural bottom plate 46 and a plastic seat cover 47, and the back 29 comprises an inside structural member 48 and a plastic back cover 49.

Figure 4:
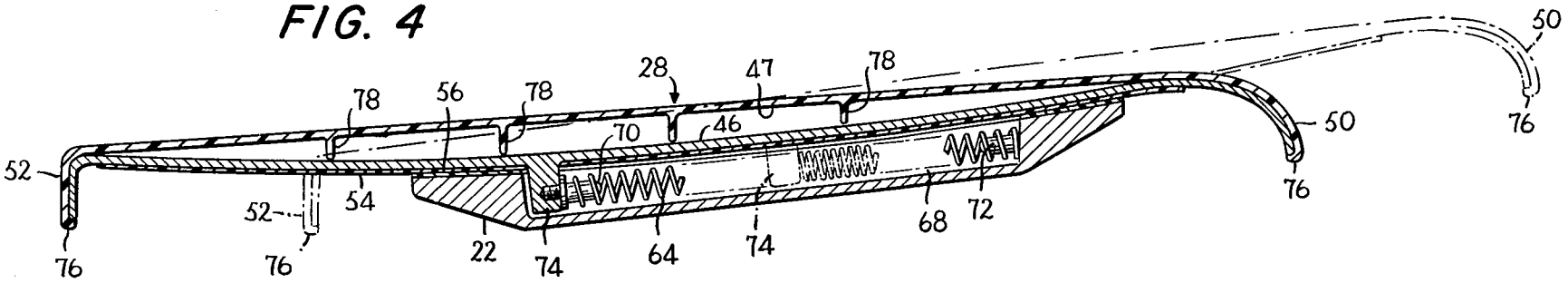

FIG. 4 shows the movement of the seat 28 between a rearward position (solid outline) and a forward position (dash-dot outline). In accordance with the invention, the seat 28 is constrained by the support means 20, 22 (FIG. 1), and particularly by the guide frame 22 (FIGS. 1 and 4), to change its orientation in response to movement between the rearward and forward positions so that the elevation of the front end 50 as compared to the elevation of the rear end 52 of the seat 28 is relatively greater when the seat is in the forward position.

The change in the orientation of the seat 28 is effected because of the way it interacts with the guide frame 22 of the seat-support means. Specifically, the seat 28 and the seat-support means including the guide frame 22 (FIG. 4) engage each other by means including a curved bearing surface 54 in order to effect the change in orientation of the seat 28 in response to its movement between the rearward and forward positions.

The curved bearing surface can be formed either on the seat 28 or on the guide frame 22, or on both of them. In the embodiment of FIG. 4, the bearing surface 54 is on the seat 28 and is convex, and a cooperating bearing surface 56 on the guide frame 22 is concave. The surfaces 54, 56 have a low coefficient of sliding friction with one another and may be formed of polytetrafluoroethylene.

Figure 5:
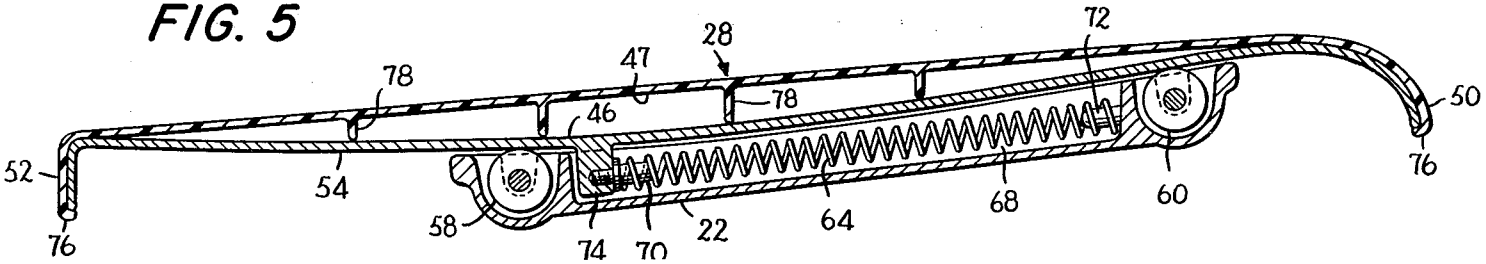
FIG. 5 is a view similar to FIG. 4 showing another representative embodiment of the invention.
Figure 6:
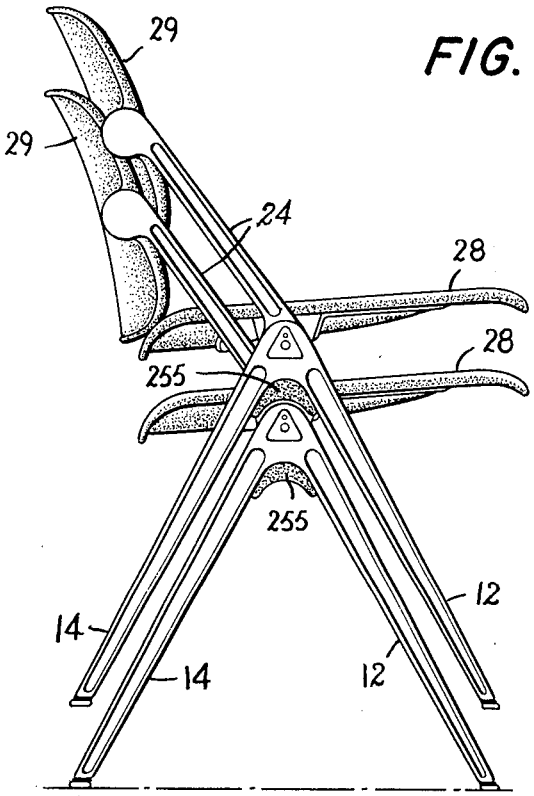
FIG. 6 is a side elevational view showing the stacking of one embodiment of chairs according to the invention.

FIG. 5 shows an embodiment in which the curved surface 54 engages a rotatable bearing means such as roller bearings 58, 60, with which it is in rolling engagement. In this embodiment of the invention, the surface 54 need not have a low coefficient of friction with the roller bearings 58 and 60, since the latter are free to turn to permit movement of the seat 28 between the rearward and forward positions.

In both embodiments, bias means such as compression springs 62, 64 (FIGS. 1, 2, 4 and 5) engages the seat 28 and urges it towards the rearward position. In the illustrated embodiments, the springs 62, 64 are received in grooves 66, 68, respectively, formed in the guide frame 22. Opposite ends of the springs fit over studs secured in the guide frame 22. In FIGS. 4 and 5, studs 70, 72 are shown for this purpose at the rearward and forward ends, respectively, of the spring 64. These studs can conveniently be screwed into the guide frame 22 at the forward end (stud 72) and into a lug 74 integral with the seat 28 (stud 70). Since the spring 64 is under compression, it biases the seat 28, which is movable on the guide frame 22, towards the left (FIGS. 4 and 5). When the chair is not in use, the front end 50 of the seat 28 is withdrawn out of the way so that, if a number of chairs according to the invention are mounted in rows in a classroom, autitorium, stadium, etc., the chair seats leave additional space between rows for people to enter and leave. Moreover, if a chair is occupied, its occupant can easily push the seat to the reat to allow space for another to pass in front while entering or leaving.

Figure 3:
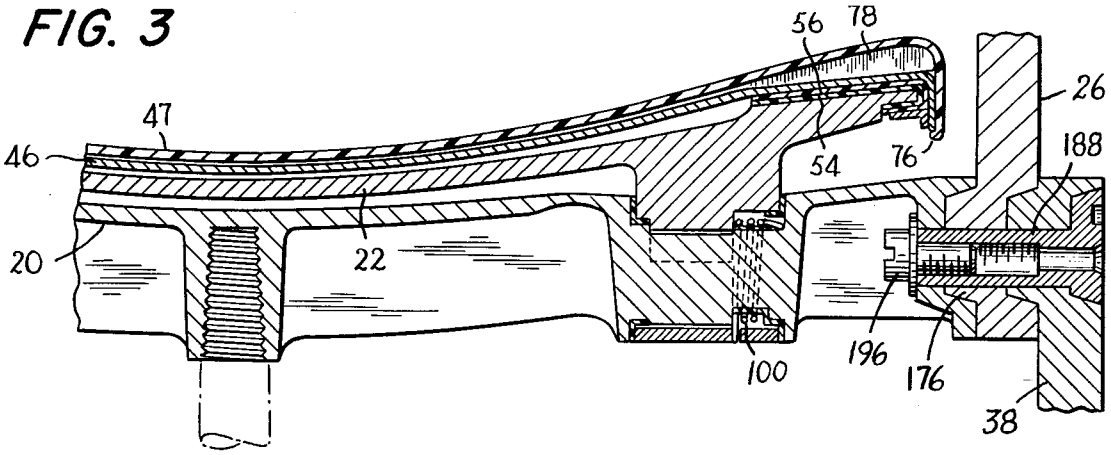
FIGS. 3 and 4 are sectional views along the lines 3—3 and 4—4, respectively, of FIG. 2.

The seat 28 comprises a bottom plate 46 and a seat cover 47 made of a plastic that is resilient but fairly stiff. As FIGS. 3, 4 and 5 show, the cover 47 is formed around its edges, or at least around a portion of its edges, with a lip or lips 76 permitting the cover 47 to be snapped over the bottom plate 46. This makes it easy to combine top plates of different colors (of alternating colors, for example) in an auditorium or the like so that the chair seats form a pattern which is a planned and integral part of the decor. This feature also makes it possible to remove the seat cover 47 if it becomes damaged (from cigarette burns, for example) and to replace it at little expense.

The seat cover 47 is preferably separated from the bottom plate 46 at least at the lateral edges of each by means such as ribs 78. This permits the lateral edges of the top plate to be elevated so that the seat has a slightly concave surface, as FIG. 3 shows.

The inside structural member 48 and back cover 49 of the back 29 fit together in the same way as the seat bottom plate 46 and seat cover 47. That is, the back cover 49 snaps over the inside structural member 48 and can be changed to provide contrasting colors in a theater, for example, or to repair cigarette burns, etc., at low cost.

The seat-support means 20, 22, is formed in certain embodiments of the invention with means permitting privotal movement of the seat 28 between a generally horizontal position (for use) and a generally vertical position (to permit cleaning and movement of people between rows). FIGS. 1, 2, 3, 8, 15, and, especially, 20 and 21 illustrate this feature. A pair of U-connections 80, 82 (FIG. 1) secure the cross brace 20 to the guide frame 22 (perhaps best illustrated in FIG. 20 for the case of the U-connection 82). The U-connections 80, 82, are themselves secured to the guide frame 22 by bolts 84, 86, respectively. These bolts pass through apertures 84*a*, 86*a*, respectively, in the guide frame 22 and are threaded into threaded holes 84*b*, 86*b*, repectively, in the U-connections 82.

Figure 20:
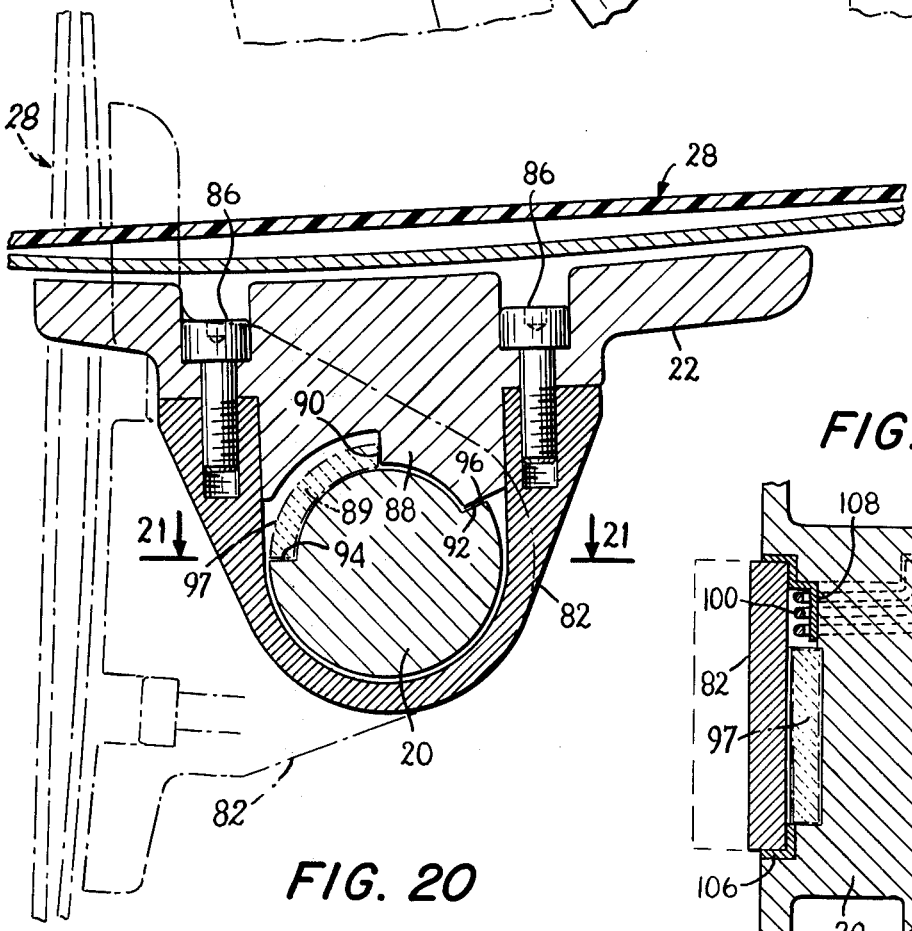
FIG. 20 is a sectional view along the line 20—20 of FIG. 2.
Figure 21:
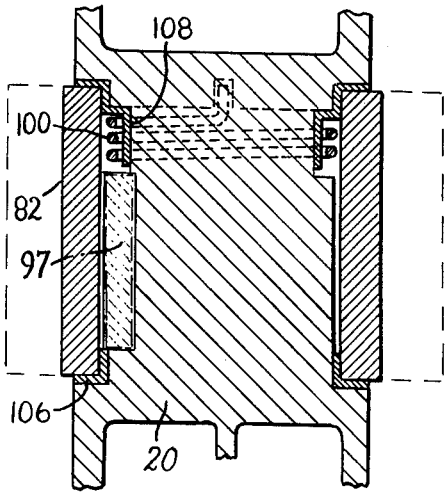
FIG. 21 is a sectional view along the line 21—21 of FIG. 20.

The guide frame 22 is formed with lugs such as the lug 88 shown in FIG. 20 adapted to ride in recesses such as the recess 89 formed in the cross brace 20. The recess 89 is arcuate and subtends an arc about 90° larger than the portion of it occupied by the lug. The lug 88 is formed with shoulders 90, 92 that cooperate with shoulders 94, 96, respectively, on the cross brace 20 and permit the seat 28 to be pivoted through an arc of about 90° between a substantially horizontal position, shown in solid outline in FIG. 20, and a substantially vertical position, shown in dash-dot outline in FIG. 20. In cases where it is desired to prevent pivoting of the seat, the arcuate slot 89 can be filled with a plug 97 (shown in dash-dot outline in FIGS. 20 and 21).

Bias means such as coil springs 98, 100 (FIGS. 1, 3 and 21) is provided to urge the seat towards one of its two pivotal limit positions. This is normally the vertical position, so that, when unoccupied, the seat is vertical and leaves ample space for cleaning and movement of people between rows of seats. Low-friction wear rings 102, 104, 106, 108 (FIGS. 1 and 21) facilitate the pivoting movement, so that the springs 98, 100 need not be inordinately strong.

Figure 18:
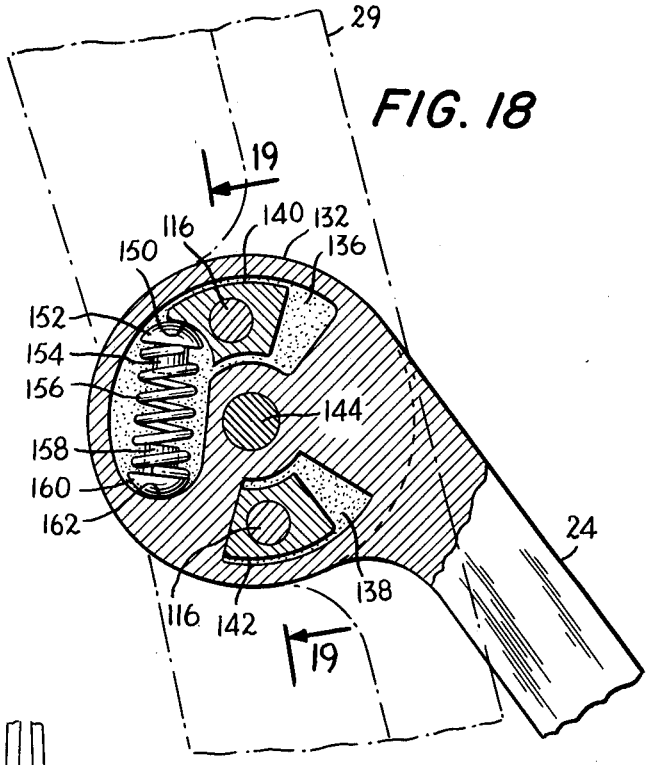
FIG. 18 is a sectional view in a vertical plane normal to the transverse dimension of the chair showing the mechanism permitting the back of a chair according to the invention to pivot between substantially vertical and inclined positions.
Figure 19:
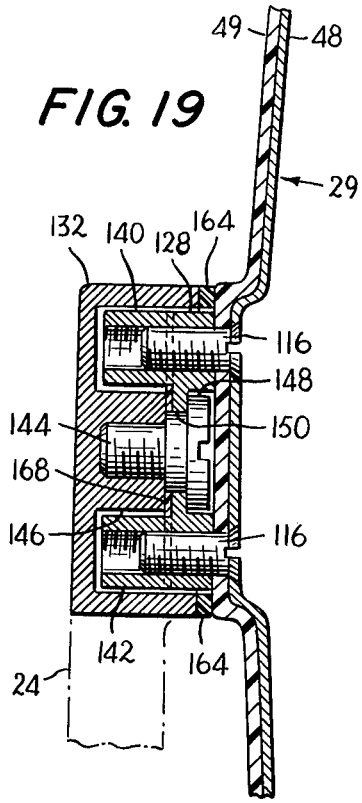
FIG. 19 is a sectional view along the line 19—19 of FIG. 18.

The back 29 and back-support means 24, 26 are connected in such a way as to permit limited pivotal movement of the back between a substantially upright position and an inclined position. FIGS. 1, 18 and 19 best show this feature. Fasteners, such as bolts or rivets 116, 118 pass through apertures 120, 122, respectively, formed in the seat back 29 and into apertures 124, 126, respectively, formed in bushings 128, 130, respectively. By this means, the bushing 128, for example (FIG. 19), is secured to the inside structural member 48 and back cover 49 of the back 29.

The top of each member of the back-support means 24, 26 is formed with cup means 132, 134. The cups function identically, and, as FIGS. 18 and 19 show, the cup 132 is formed with spaced-apart arcuate grooves, 136, 138 adapted to accommodate lugs 140, 142, respectively, formed on the bushing 128.

A pivot pin 144 is threaded into an aperture in a central lug 146 formed in the cup 132. The head 148 of the pin 146 engages an annular shoulder 150 formed on the interior surface of the bushing 128. The pivot pin 144 thus secures the seat back 29 to the back-support means 24. However, since the arcuate grooves 136, 138 subtend larger arcs than do the lugs 140, 142, there is room for the back 29 to pivot. As it does so, a shoulder 150 of the lug 140 engages a bead 152 formed with a stud 154 around which is wrapped one end of a compression coil spring 156. The other end of the spring 156 is wrapped around a stud 158 secured to a bead 160 that abuts the end 162 of the arcuate groove 136.

Accordingly, when a user of the chair leans back, applying pressure to the seat back 29 above the pivot 144, he is able to pivot it from a normally nearly vertical position to an inclined position more comfortable to the user. When he gets up, the spring 156 causes the bead 160 to push against the shoulder forming the end 162 of the slot 136 and the bead 152 to push against the shoulder 150, which is rigidly connected by the screws 116 to the back 29. This returns the back 29 to a substantially vertical position and increases the space between rows to facilitate cleaning and movement of people between rows.

The relative movement between the seat back 29 and its support is facilitated by low-friction rings 164, 166 (FIGS. 1 and 19) between each cup and the seat back and 168, 170 (same figures) between each central lug and associated bushing.

Another aspect of the invention is that it comprises modular fitting means permitting direct connection of any one to any other of various modular components that can be included or omitted as required. The modular fitting means comprises projecting means formed on at least one and corresponding recess means formed in the other of any connected two of a number of modular components, which may include seat-support, back-support, arm-rest, and leg means, for example. Thus, in FIG. 1, the cross brace 20 is formed with triangular recesses at opposite ends, one of which, a recess 172, is shown. The back supports 24, 26 are formed with triangular projections 174, 176 on the inner sides of their lower ends that are complemental to the recesses in the cross brace 20 and fit snugly therein so that the back supports 24, 26 form a rigid connection with the cross brace 20. While projections and recesses having triangular sections in planes normal to the projection or recess axis and to the transverse dimension of the chairs are shown, any non-circular section or combinations of sections can in principle be used to form a rigid connection between joined parts.

On the outer sides of the lower ends of the back supports 24, 26 triangular recesses are formed. One of these, a recess 178, is shown in FIG. 1. This recess is identical in size and shape to the recess 172.

On the inner sides of the upper ends of the junctions 30, 32 of the legs 12, 14 and 16, 18, respectively, are triangular projections 180, 182. On the outer sides of the legs 12, 14 and 16, 18 at the junctions 30, 32 and opposite the projections 180, 182, respectively, are triangular recesses. One of these, a recess 184, is shown in FIG. 1.

In line with the cross brace 20 there are thus two triangular projections and three triangular recesses on either hand. All of the projections are identical, as are all of the recesses. Moreover, the projections are complemental to the recesses, so that any one of the projections can be received within any one of the recesses to form a rigid connection. This permits the several parts to be put together in various ways. This capability has particular utility in some of the other embodiments described later on.

FIGS. 22 and 23 show in greater detail how the parts shown in FIG. 1 fit together and how two chairs according to the invention may be easily hooked together in side-by-side relation, either chair being to the right of the other. In FIG. 22, the leg 12, cross brace 20 and back support 24 of the chair of FIG. 1 are shown in dash-dot outline. This structure is at the right side of the chair (the left of FIG. 1). Similarly, FIG. 22 shows the left side of an adjoining chair comprising a leg 16′, a cross brace 20′ and a back support 26′. These parts fit together by means of the triangular or otherwise non-rotatable connections shown in FIG. 1 and described above. The three parts of each chair shown in FIG. 22 are held together by pins 186, 188′, respectively. Two such pins 186, 188 are visible in FIG. 1. The pins are formed with center bores, which need not have the same diameter all the way through. Screws 190, 192 are threaded into the bore at opposite ends of the pin 186; similarly, screws 194′, 196′ are threaded into the bore at opposite ends of the pin 188′. The heads of the screws 190, 194′ are tapered as indicated at 198, 198′ so that they secure hook means 200, 200′ to the pins 186, 188′, respectively.

The hook member 200 is formed with a pin 202 that fits within a recess 204 formed in the head 206 of the pin 186. Similarly, the hook member 200′ is formed with a pin 202′ that fits within a recess 204′ formed in the head 206′ of the pin 188′. The hook 200 is formed with a conical aperture 208 complemental to the tapered head 198. Similarly, the hook 200′ is formed with a conical aperture 298′ complemental to the tapered head 198′. The screws 190, 194′, when threaded into the bores of the respective pins 186, 188′, thus secure the hooks 200, 200′, respectively, to the pins 186, 188′ and thereby to the two chairs.

The hooks 200, 200′ are formed with a dovetail assembly 210*a, b,* shown in FIGS. 22 and 23 and on a smaller scale in FIG. 1. By virtue of the dovetail construction, it is possible to hook adjacent chairs together or separate them without tools simply by lifting one slightly and lowering it so that the dovetail hook structure common to the two chairs engages. Because the dovetail hook structure is substantially V-shaped in a plane normal to the transverse dimension of the chairs, it is not necessary that the chairs be perfectly aligned in order to hook them together. On the contrary, automatic correction of a slight misalignment is made as the raised chair is lowered: one edge of each V slides relatively along the corresponding edge of the other V until the vertices and opposite edges of the V's are brought into engagement. A long row of chairs in accordance with the invention can thus be assembled evenly spaced apart in a straight line in minimum time and with minimum trouble. This feature is particularly useful in multipurpose rooms in which chairs must be set up for certain functions and removed for others.

Figure 7:
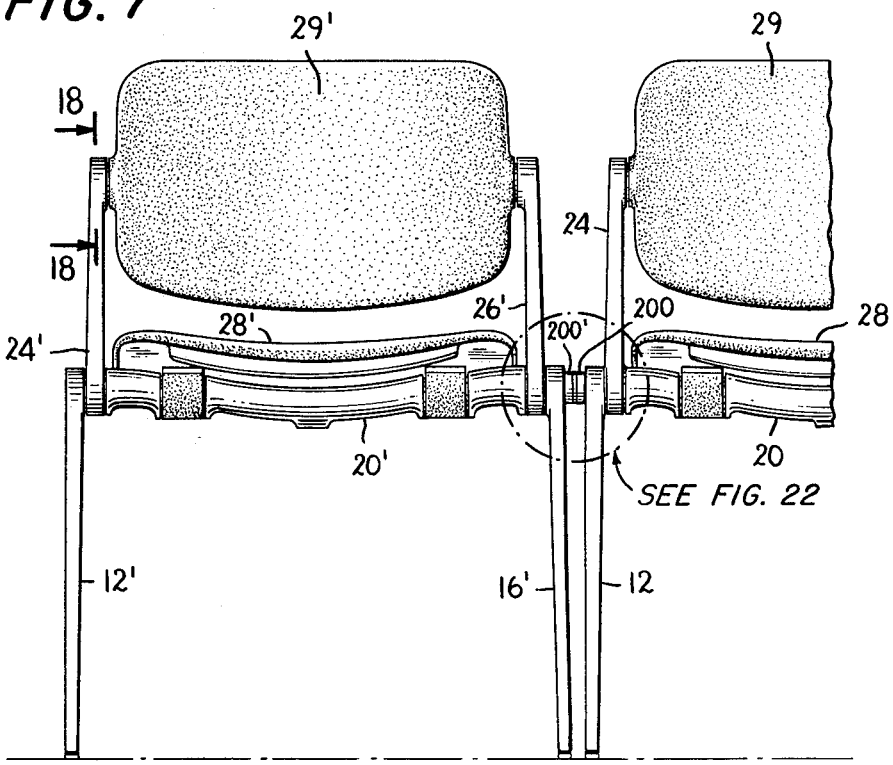
FIG. 7 is a front elevational view showing one way of joining chairs in side-by-side relation according to the invention.
Figure 8:
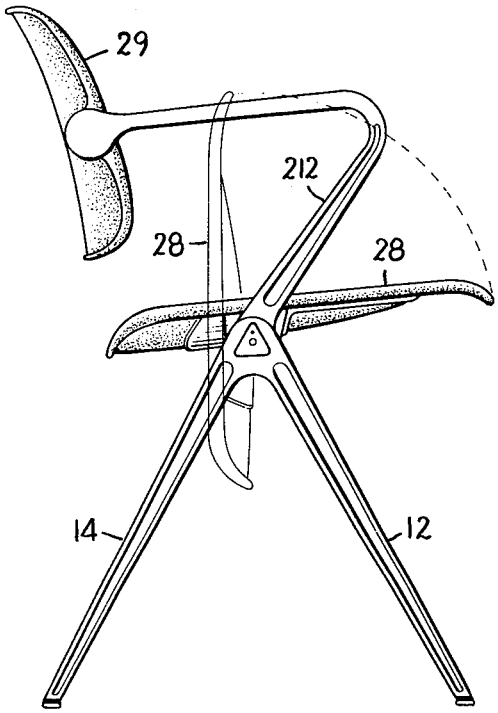
FIGS. 8 and 9 are side and front elevations, respectively, of another embodiment of a chair according to the invention.
Figure 9:
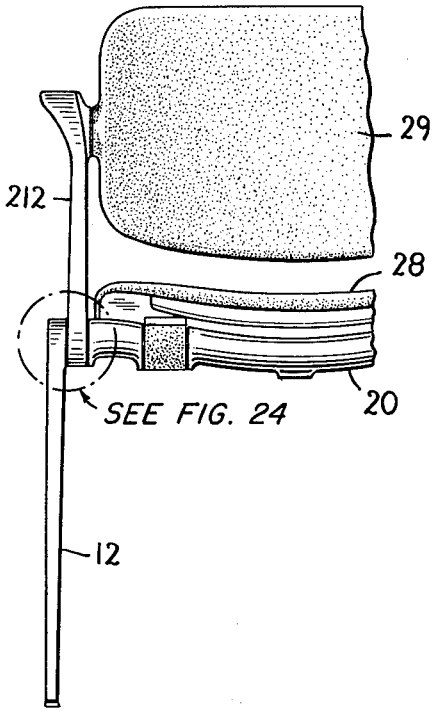
Figure 10:
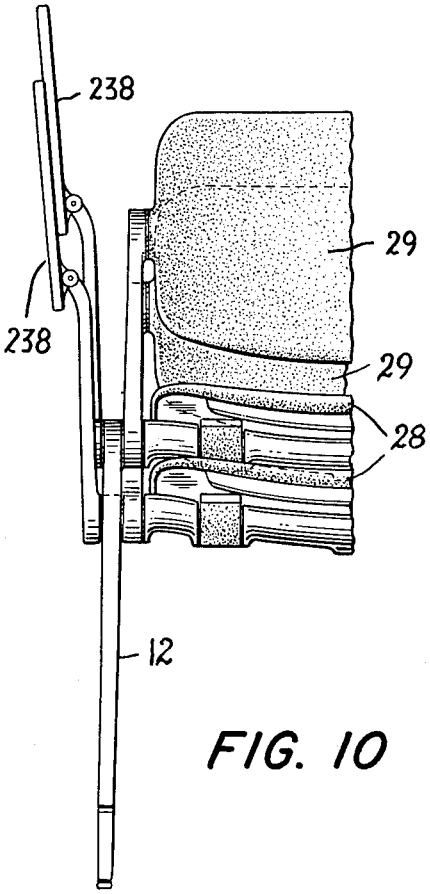
FIG. 10 is a fragmentary front elevation showing the stacking of still another embodiment of chairs according to the invention.

FIGS. 8, 9 and 24 show an embodiment similar to that of FIGS. 7 and 22 but adapted to a chair an arm-and-back-support means 212. In this embodiment, a single member on either side of the chair serves both as an arm rest and as a means for supporting the back of the chair. At its lower end, it is formed like the lower end of the back support 24 (FIG. 22).

Figure 12:
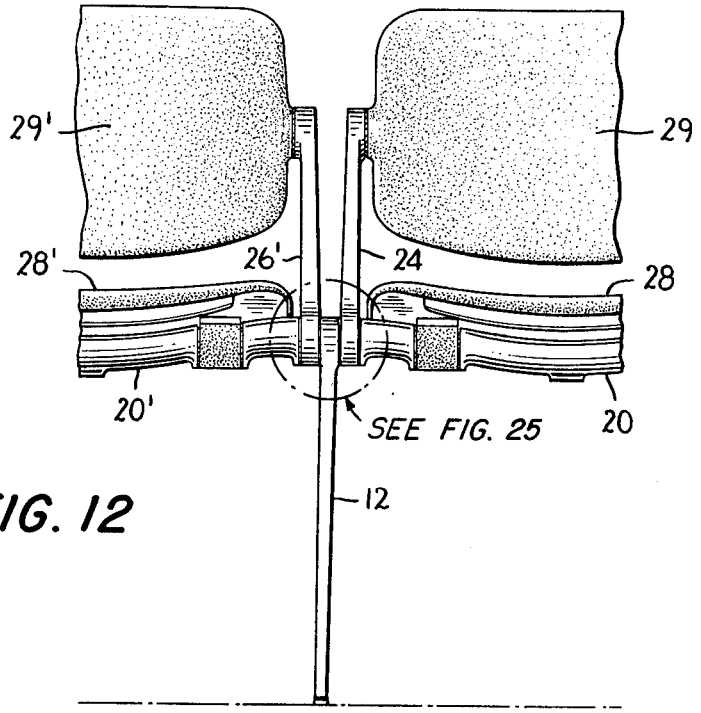
FIG. 12 is a front elevation showing another way of joining chairs according to the invention in side-by-side relation.
Figure 13:
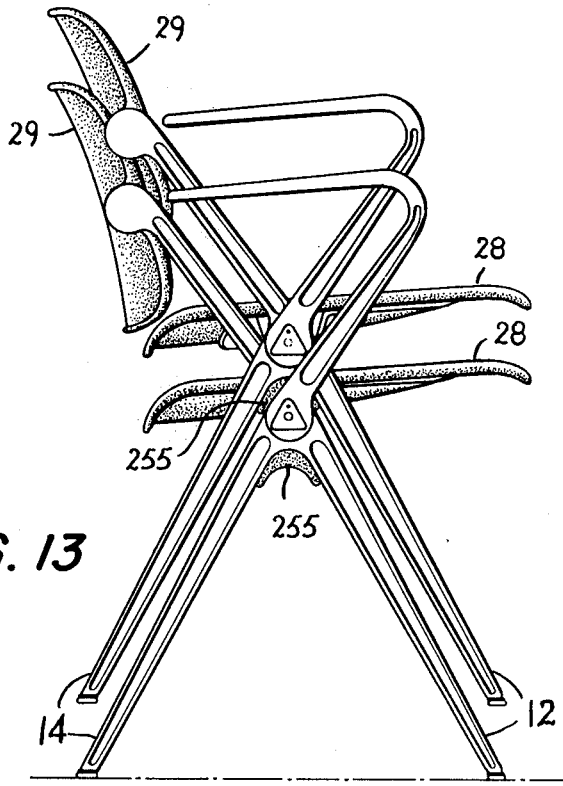
FIGS. 13 and 14 are a side elevation and a fragmentary front elevation, respectively, showing the stacking of another embodiment of chairs according to the invention.
Figure 14:
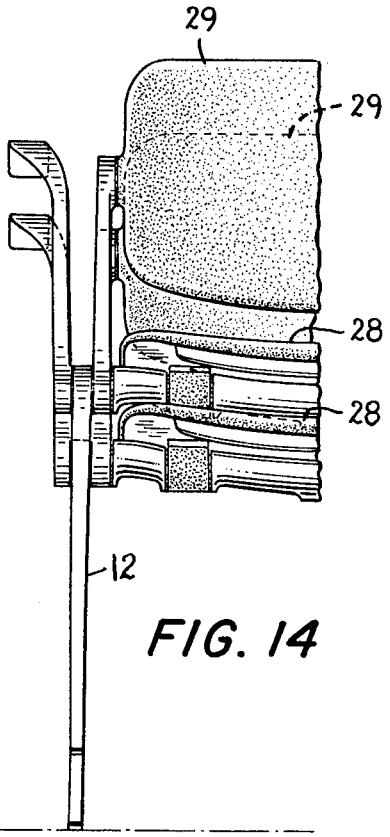

FIGS. 12 and 25 show another embodiment of modular fitting means for joining two chairs side-by-side in a more permanent installation. The cross braces 20, 20′, back supports 24, 26' and leg 12 are similar to structure described above. A single pin 214 formed with a bore 215 extends through both cross braces 20, 20', both back supports 24, 26', and the leg 12. Bolts 216, 216' are passed through washers 218, 218', respectively, and threaded into opposite ends of the pin 214.

The recesses and projections of triangular or other non-circular shape form non-rotatable connections between the leg 12 and the back support 24, between the back support 24 and the cross brace 20, and between the back support 26' and the cross brace 20'. However, the leg 12 and back support 26' both have recesses; neither has a projection cooperating with the recess of the other. Accordingly, the pin 214 is formed with a double-tapered flange 220 having a tapered portion 222 fitting within a cooperating recess in the leg 12 and a tapered portion 222' fitting within a cooperating recess within the back support 26'. In this way, the cross braces 20, 20', back supports 24, 26', leg 12 and pin 214 are joined in a rigid structure.

FIGS. 15, 16, 26 and 27 show the invention in another embodiment, which is a further development of the one described immediately above. A pedestal 224 supports one end of a row of chairs the other end of which is supported by an identical pedestal (not shown). Alternatively, each chair may be supported by its own pedestal, or every second or third chair, for example, may be supported by a pedestal, the remaining chairs having no pedestal but being supported by their attachment to chairs on either side.

Figure 15:
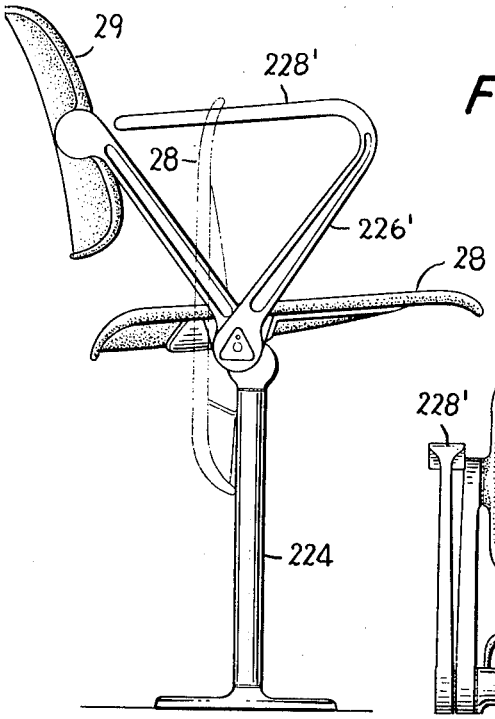
FIG. 15 is a side elevation of another embodiment of a chair according to the invention.
Figure 16:
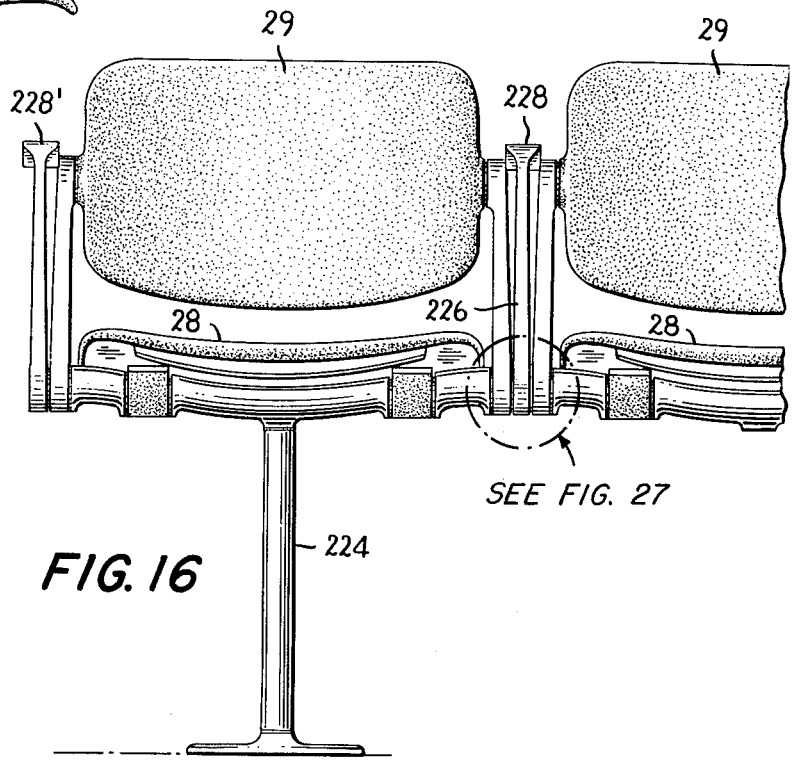
FIG. 16 is a front elevation showing the joining of two chairs according to FIG. 15 in side-by-side relation.

The attachment shown in FIGS. 26 and 27 is similar to that shown in FIG. 25, except for a difference occasioned by the structure of the support 226 for an arm rest 228 or 228' (FIGS. 15 and 16). The support 226 has no projection to cooperate with the recess in the back support 24; accordingly, a sleeve 230, which may be made of plastic, is provided having a tapered portion 232 that fits within a complemental recess formed in the back support 24 and a tapered portion 232' that fits within a complemental recess formed in the arm-rest support 226. It is thus similar to the double-tapered flange 220 with its tapered portions 222 and 222' but, instead of being integral with the pin 214, is removable, as FIG. 26 shows.

Figure 17:
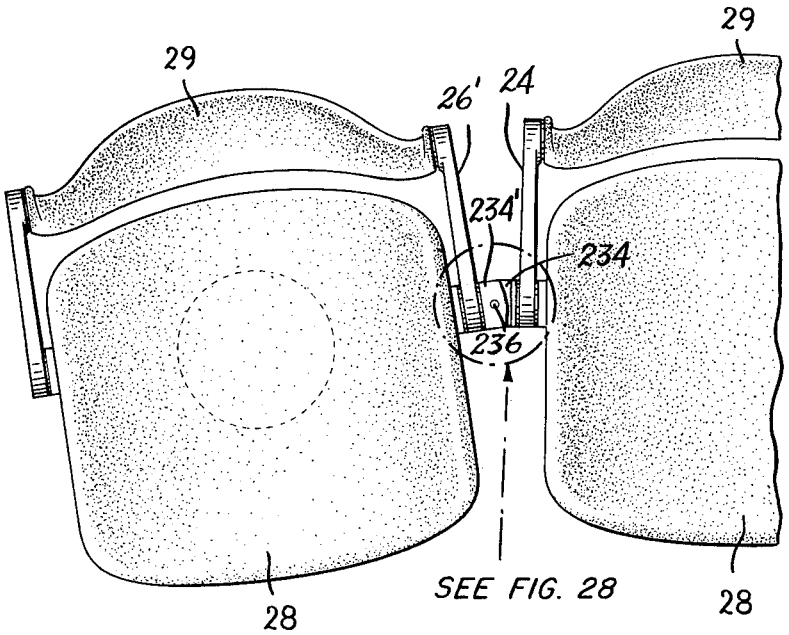
FIG. 17 is a top plan view showing another way of joining chairs in side-by-side relation according to the invention.

FIGS. 17, 28 and 29 show another embodiment of the modular fitting means, in which adjacent chairs are joined together in such a way that they can pivot to a limited extent with respect to one another so that they can be arranged in curved rows. This permits parallax compensation, and each chair can face the same point, a podium, for example, in a room such as an auditorium. Back supports 24, 26' for adjoining chairs are formed with recesses filled by tapered flange projections of triangular or other non-circular cross sections 232, 232'. These flanges are on separate coupling members 234, 234' articulated by a vertical pivot pin 236. The structure is otherwise similar to that described above and permits limited pivotal movement of the chairs with respect to one another in a horizontal plane.

Figure 32:
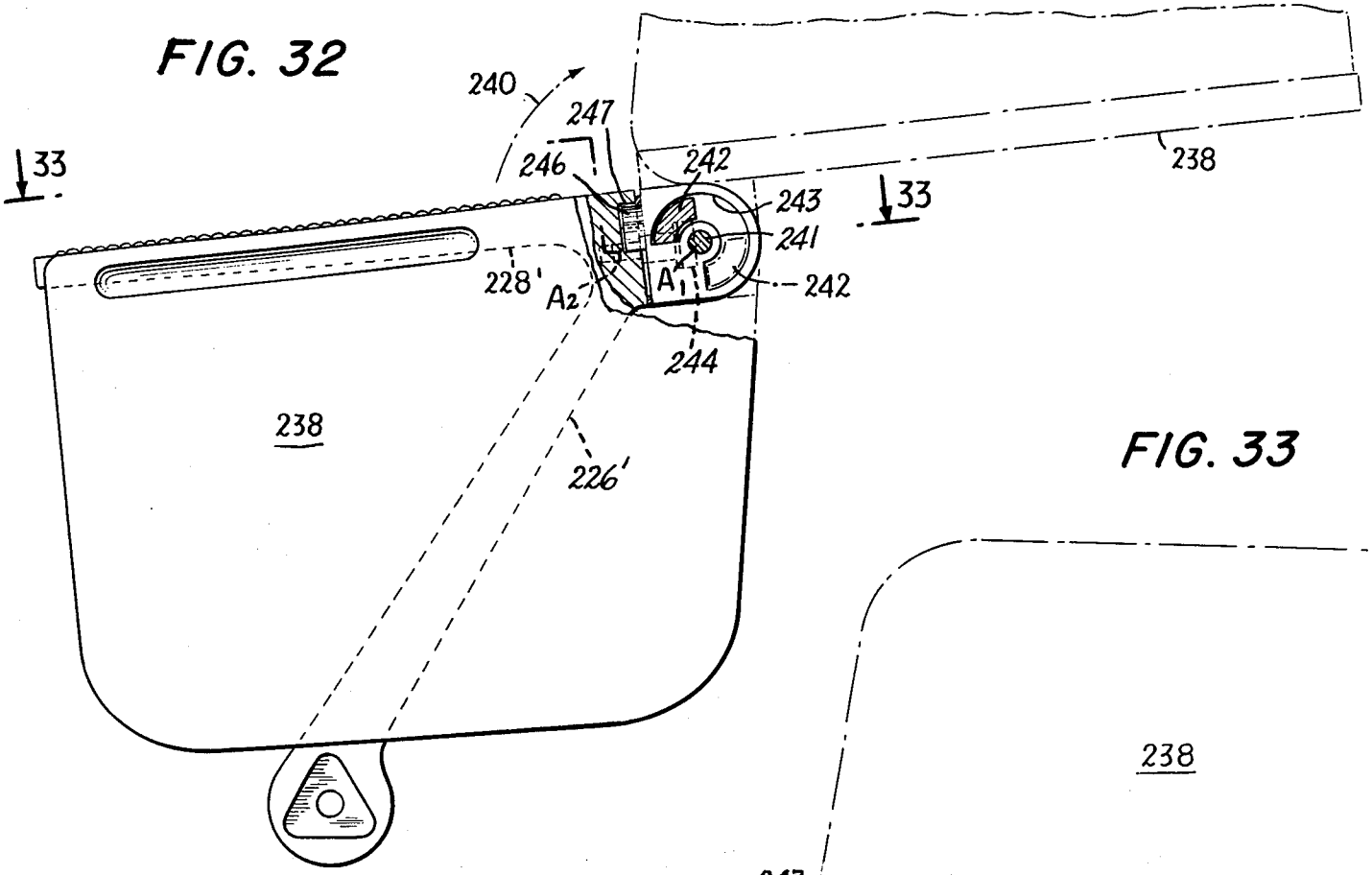
FIG. 32 is a fragmentary side elevation of a chair comprising a double-pivoted writing arm according to the invention.
Figure 33:
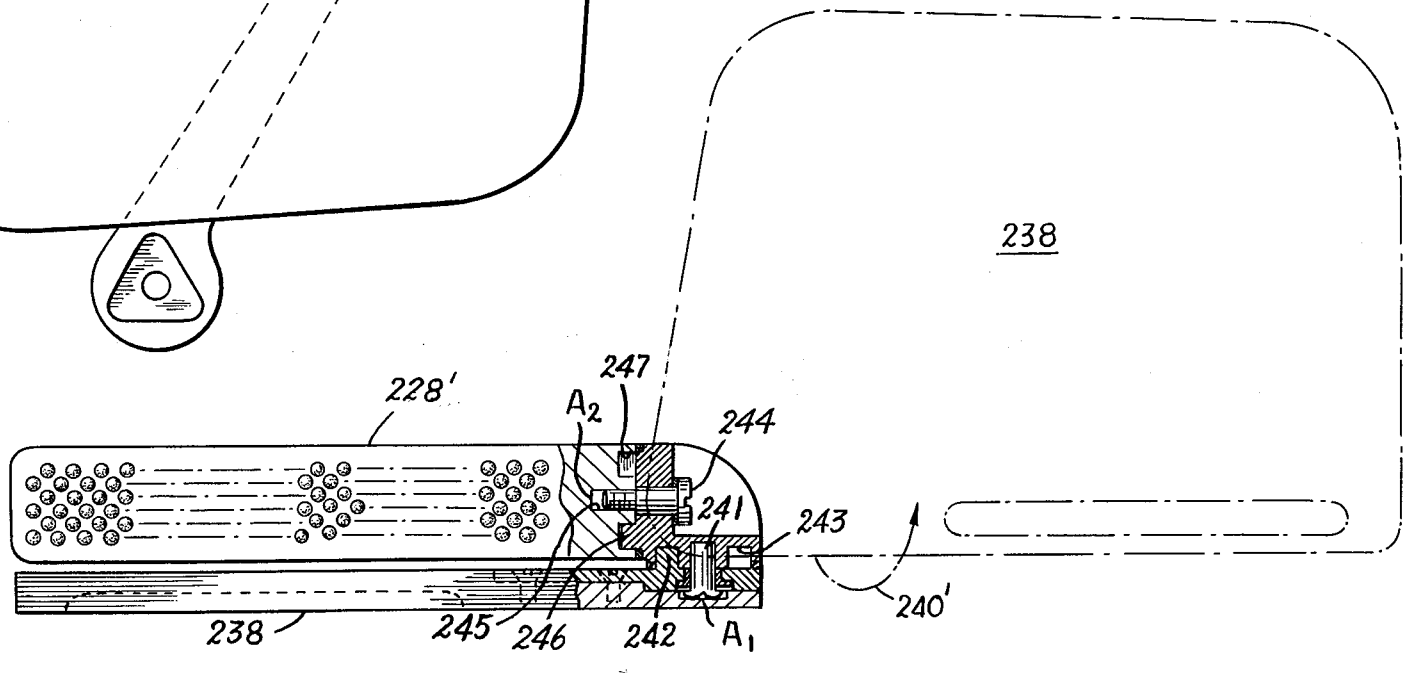
FIG. 33 is a top plan view of the structure shown in FIG. 32.
Figure 34:
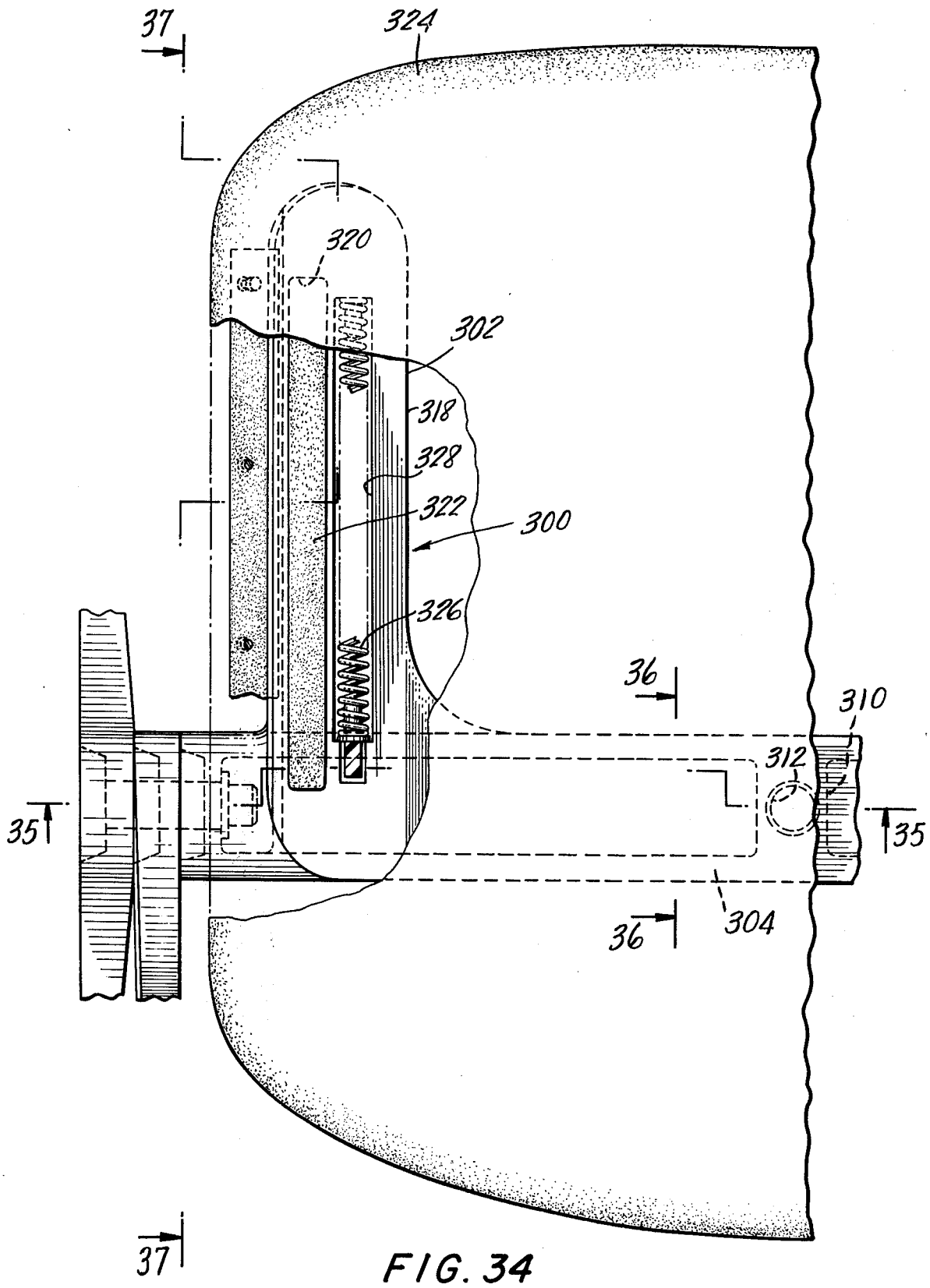
FIG. 34 is a partial top view showing a modified seat structure, portions of the seat being broken away for clearer illustration.
Figure 36:
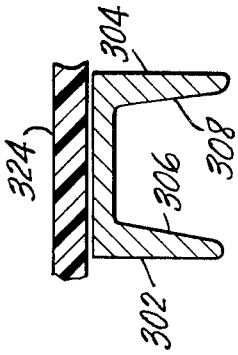
FIG. 36 is a cross-sectional view of the transverse part of the seat support of the seat structure of FIG. 34 taken generally along a plane represented by the lines 36—36 of FIG. 34 and in the direction of the arrows.

FIGS. 32 and 33 disclose an embodiment of the invention provided with a writing arm that can be pivoted about a first axis $A_1$ extending transversely of the chair so that the arm is brought from a hanging to an elevated position beside the chair, the writing arm in both positions being substantially in a vertical plane, and that can also be pivoted about a second axis $A_2$ extending in a direction parallel to the fore-and-aft direction of the chair so that the arm is brought from the elevated position beside the chair to a horizontal position at the front of the chair.

In FIG. 32, the writing arm 238 is shown (solid outline) in a hanging position beside the chair, which is provided with an arm rest 228' supported by a support 226' as in FIG. 15, for example. An arrow 240 shows the pivoting movement of the writing arm 238 in a clockwise direction about the pivot axis $A_1$ through an angle of about 180° to an elevated position in a vertical plane beside the chair shown in dash-dot fragmentary outline.

In FIG. 33, the writing arm 238 is also shown (solid outline) in a hanging position beside the chair. An arrow 240' moreover shows the pivoting movement of the writing arm 238 about the pivot axis $A_2$ through an angle of about 90° from the vertical position shown in dash-dot outline in FIG. 32 to the horizontal position in front of the chair shown in dash-dot outline in FIG. 33.

The pivoting of the arm 238 about the axis $A_1$ is facilitated by a pivot pin 241, which may be a rivet. A lug 242 integral with the arm 238 rides in a slot 243 that is stationary with respect to the chair. The slot 243 is arcuate and the portion of it unoccupied by the lug 242 subtends an arc of about 180°. The pivoting of the arm 238 about the axis $A_2$ is facilitated by a pivot pin 244, which may be threaded into a bore 245 so that it can be removed, thus permitting the writing arm to be slid horizontally (toward the right of FIG. 33) so that it is removed from the chair. A lug 246 integral with the arm 238 rides in a slot 247 that is stationary with respect to the chair. The slot 247 is arcuate and the portion of it unoccupied by the lug 242 subtends an arc of about 90°.

Figure 30:
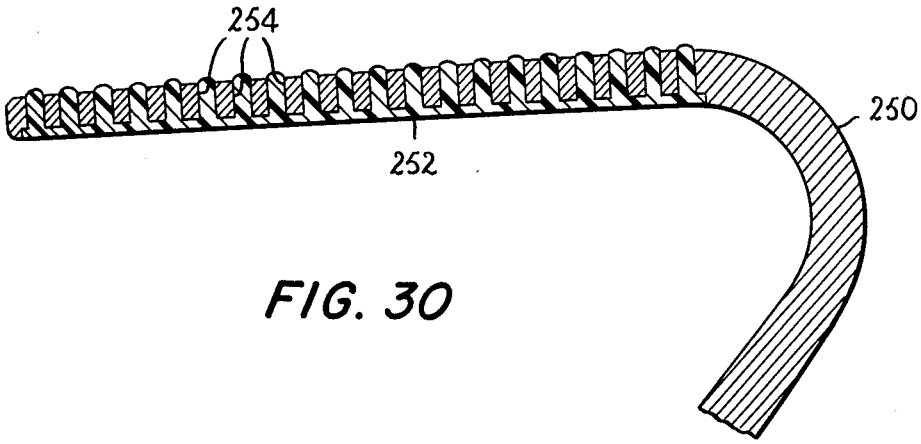
FIG. 30 is a fragmentary sectional view in a vertical plane of a cast-aluminum arm rest incorporating a plastic in accordance with the invention.
Figure 31:
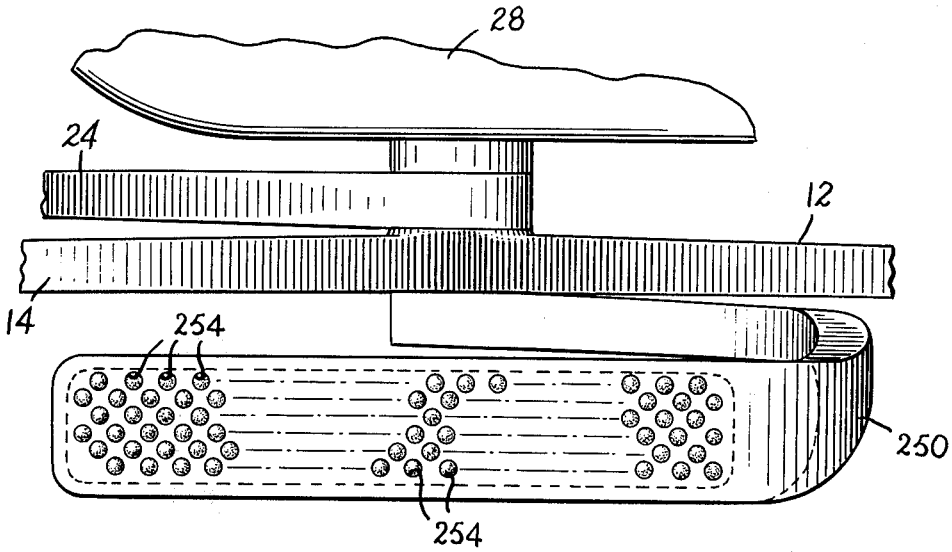
FIG. 31 is a top plan view of the structure of FIG. 30.

FIGS. 30 and 31 illustrate a chair arm rest comprising a structural portion of a metal, such as cast aluminum, and a plastic insert. The structural part is formed with holes passing therethrough, and the plastic insert has bosses that project through the holes and provide a visible, raised pattern on the top of the arm rest. The pattern as illustrated in FIG. 31 comprises a regualr array of separated dots. Other designs will occur to those skilled in the art of design. The plastic dots enhance the appearance of the chair, whether it is viewed alone or with many similar chairs in an auditorium, for example. Moreover, they insulate the arm of a user from contact with the aluminum, which is a good conductor of heat and may feel too cold if indoors or if outdoors on a cold day and on the other hand may feel much too hot if in the sun on a warm day.

Chairs made in accordance with the invention can be stacked in such a way as to occupy little space, as FIGS. 6, 10, 13 and 14 show. This is so even though the chair legs are not designed to be folded. To facilitate stacking, inserts **255, 255*a* (FIGS. 1, 6 and 13) are provided for insertion into slots 255*b*, 255*c* at the leg junctions 30, 32, respectively. These inserts are preferably made of plastic so that the chairs can be stacked as in FIGS. 6 and 13** with no metal-to-metal contact.

Figure 11:
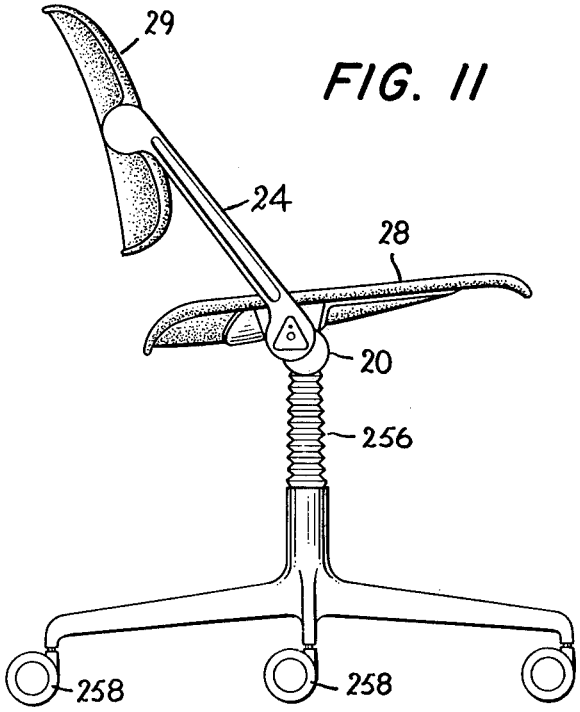
FIG. 11 is a side elevation of an office-type chair according to the invention.

Moreover, different types of bases can be provided, including an office-type chair (FIG. 11) having a threaded leg 256 connected to the cross brace 20 so that the height of the seat 28 can be adjusted by relative rotation between the cross brace 20 and the leg 256. This adjustment in height of the seat 28 is of course independent of the relative elevation of the front end of the seat as it moves forward with respect to its support as illustrated in, for example, FIG. 4. The chair shown in FIG. 11 is moreover provided with means such as casters 258 permitting the chair to be rolled about in an office work area by the user.

Figure 35:
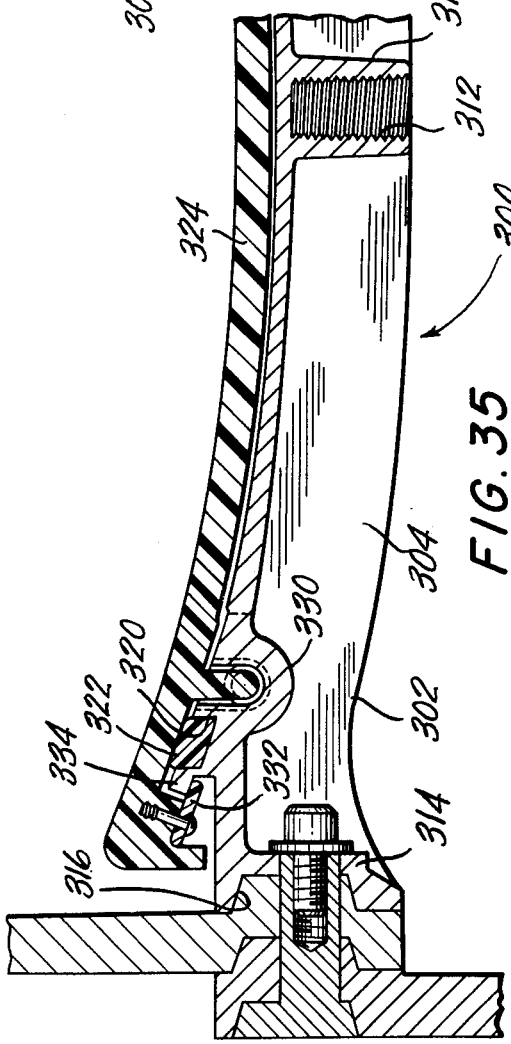
FIG. 35 is a partial cross-sectional view of the seat structure of FIG. 34, the section being taken generally along a plane represented generally by the lines 35—35 of FIG. 34 and in the direction of the arrows.
Figure 37:
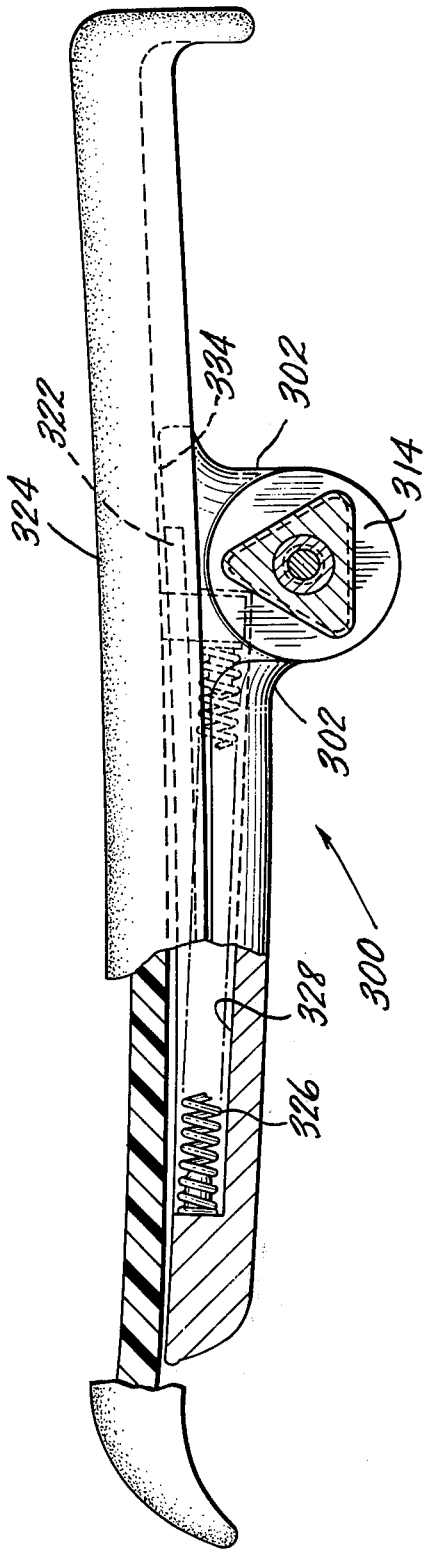
FIG. 37 is a side view of the seat structure shown in FIGS. 34 to 36, a portion being broken away along the lines 37—37.

FIGS. 34 to 37 illustrate an alternative form of seat structure, one which involves modifications of the seat structure of FIG. 1 but is fully compatible with the legs, back supports, arms and other elements described above, and, like the embodiment of FIG. 1, provides for backward and forward movement of the seat. One of the modifications is the elimination of the provisions for tilting of the seat structure between generally horizontal and generally vertical positions. More particularly, the seat structure which is designated generally by the reference numeral 300 in FIGS. 34 to 37 comprises a seat support 302 that is generally U-shaped in plan, is contoured transversely to present a generally concave surface facing upwardly and has a moderately upwardly concave shape in side elevation (FIG. 37). The transverse portion 304 of the seat support 302 is an inverted channel section having a pair of downwardly projecting, spaced-apart flanges 306 and 308, the transverse portion thus being equivalent to the beam 20 of FIG. 1 in that it provides transverse strength and rigidity. A web 310 extends between the flanges 306 and 308 at the center of the transverse portion and has a threaded hole 312 for receiving a pedestal form of leg (see, for example, FIGS. 11, 15 and 16). Each end of the transverse portion 304 also includes a web 314 that extends transversely between the main lengthwise flanges 306 and 308 and has a key formation 316 on the downwardly facing side and a hole through it, the arrangement of the ends of the transverse portion 304 thus being substantilly the same as the connector arrangement described above and shown in FIG. 1 (for example) at the end of the beam 20. FIG. 35 illustrates portions of a leg and a back support installed on the connector portion of the seat support 302.

Each of the legs 318 that extend forward from the transverse portion 304 (only one of the legs is illustrated in FIGS. 34 to 37) includes a somewhat thickened outer portion and an upwardly open, longitudinal extending groove 320 formed in the relatively thicker outer portion. An insert 322 of a low friction material such as nylon or felt is installed, such as by gluing, in the groove 320, the insert 322 providing a sliding surface for supporting the seat 324 for backward and forward movement relative to the seat support. Although the sliding arrangement between the seat support and the seat in the embodiment of FIGS. 34 to 37 is structurally somewhat different from that shown in FIGS. 3 and 4 and described above, the principle and end result are similar. As in the embodiments described above, a spring 326, which is located in a longitudinally extending concavity 328 formed in an enlarged (in cross-section) portion 330 of each leg 318 of the seat support urges the seat 324 to its rearwardmost position and limits the forward extent of movement at the fully compressed stage.

The embodiment of FIGS. 34 to 37 of a seat structure for use in the chair also involves a modified seat 324, namely a one-piece seat formed of a suitable material, preferably a plastic such as structural polyurethane. The seat is appropriately contoured, as illustrated, and is retained on the seat support 302 by a pair of retainer strips 332 fastened to the underside of the seat, one on each side, and projecting under a retainer flange 334 formed along the outer edge of each leg 318 of the seat support.

The main structural parts of the chairs, such as the legs, back supports, arms, and seat supports are preferably made of cast aluminum, and the embodiments shown in the drawings are based on that method and material. It is, however, within the ordinary skill of the art to employ other materials and methods in the manufacture of all of some of the various parts; for example, all parts of the chair can be made of stamped steel with appropriate changes in the specific and detailed design of the parts.

Thus there is provided in accordance with the invention a novel and highly-effective chair having features that make it unusually confortable, attractive, inexpensive, easy to assemble, utilitarian, and adaptable to mass production and to use in a wide variety of environments. Those skilled in the art will understand that the invention includes embodiments in addition to the representative ones disclosed above and is as broad as the appended claims and their equivalents.

I claim:

1. A chair comprising as the sole transverse structure of a frame of the chair a beam-like member, legs attached to and dependent from the beam-like member and supporting the beam-like member at a height essentially equal to that of a chair seat, a seat, a seat support mounted on the beam-like member and including a pair of laterally spaced-apart portions extending forwardly from regions adjacent the respective ends of the beam-like member thereby to be in cantilevered relation to the beam-like member, each said portion of the seat support having an upwardly facing concave bearing surface, and the seat being supported on said portions of the seat for movement to any position between a rearward position and a forward position, and for variation of the rake of the seat in response to said movement so that the elevation of the front end of the seat as compared to the elevation of the rear end of the seat is relatively greater when the seat is in the forward position than when it is in the rearward position, by virtue of the curvatures of the bearing surfaces of said portions, a back, and means mounting the back for limited pivotal movement independently of the seat to any position between a substantially upright position and an inclined position.

2. A chair according to claim 1 wherein the seat includes a bearing surface adjacent each side and in sliding engagement with a corresponding bearing surface of the seat support portions, the coefficient of friction between said bearing surfaces being low.

3. A chair according to claim 1 and further comprising legs supporting the seat support and back mounting means, and connector means for directily connecting in sandwiched relation any one to any other of said seat support, back support means and legs.

4. A chair according to claim 3 wherein said connecting means includes key-tape projections formed on at least one and complemental recesses formed in the other of any connected two of said seat support, back mounting means and legs.

5. A chair comprising a seat structure, a connector element at each side of the seat structure, each connector element including a key-type formation, each such formation being identical to the other, a back, a pair of back supports, each of the back supports being connected to respective sides of the back and each back support including a connector portion having a key-type formation complementary to the formations on the connector elements of the seat structure for interengagement therewith rigidly to position the back support on a respective connector element of the seat structure and a key-type formation matching the formations on the connector elements of the seat structure, a pair of leg members, each leg member having a connector portion having a key-type formation complementary to the formations on the connector elements of the seat structure for interengagement therewith rigidly to mount the leg member on the side of the seat structure in engagement with a respective back support, and fastener means securing the connector portion of each back support to a respective connector element of the seat structure and connecting a back support and a respective leg member to the respective connector element at each side of the seat structure.

6. A chair according to claim 5 and further comprising a pair of arm rest members, each of which includes a supporting portion having a connector portion for attachment to a respective connector element of the seat structure, the connector portion of each arm rest member including a first key-type formation complementary to to the key-type formation on each connector element of the seat structure and a second key-type formation matching the key-type formation on each connector element of the seat structure such that the arm rest is adapted to be mounted rigidly on the seat structure in sandwiched relation or at the end of a series of one or more connector portions of a leg member and a back support.

7. A chair according to claim 5, wherein the back support includes an arm rest portion extending generally forwardly from the back and a supporting portion extending generally downwardly and rearwardly from the front end of the arm rest portion, the back support member being generally V-shaped in elevation.

8. A chair according to claim 5 and further comprising a writing table and a support member for the writing table; the writing table support member including a connector portion having a first key-type formation complementary to the key-type formation on each of the connector elements of the seat structure and a second key-type formation matching the formation at each end of the seat support member such that it may optionally be mounted in sandwiched relation or at the end of a series of connector portions of a leg member and back support.

9. A chair according to claim 8 wherein the writing arm includes means permitting pivoting the writing table about a first axis parallel to the transverse dimension of the chair so that the table is brought from a hanging to an elevated position beside the chair, the writing table in both the hanging and elevated positions being substantially in a vertical plane, and means permitting pivoting the writing table about a second axis parallel to the fore-and-aft dimension of the chair so that the table is brought from the elevated position beside the chair to a horizontal position generally at the front of the chair.

10. A chair according to claim 5 wherein the seat structure comprises a seat and a seat support, the seat support including a beam-like member extending transversely and located below the seat and a plate-like member mounted on the beam-like member, and further comprising means mounting the seat on the seat support for forward and backward movement relative to the seat support, and wherein the connector elements of the seat structure are located at the ends of the beam-like member.

11. A chair according to claim 10 wherein the plate-like member of the seat support is mounted on the beam-like member of the seat support for pivotal movement generally about the axis of the beam-like member to enable the seat structure to pivot between a generally horizontal and a generally vertical position.

12. A chair according to claim 5 wherein the seat structure includes a seat and a seat support located under the seat and including means supporting and guiding the seat for movement between a rearward position and a forward position.

13. A claim according to claim 12 wherein the seat supporting and guiding means includes means for varying the rake of the seat in response to said movement thereof so that the elevation of the front end of the seat as compared to the elevation of the rear end of the seat is relatively greater when the seat is in the forward position than when it is in the rearward position.

14. A chair according to claim 13 wherein the seat and the seat support engage each other by means including a curved bearing surface on one of said seat and said seat support, the bearing surfaces being shaped to provide said variation in the rake of the seat as a function of a movement of the seat between said rearward and forward positions.

15. A chair according to claim 14 wherein it is the seat that has the curved bearing surface, said surface being convex towards the seat support.

16. A chair according to claim 14 wherein the seat and the seat support engage each other by means also including an additional bearing surface formed on the other of said seat and said seat support, said additional bearing surface being in sliding engagement with said first-named bearing surface, the coefficient of friction between said bearing surfaces being low.

17. A chair according to claim 14 wherein the seat and the seat support engage each other by means also including rotatable bearing means mounted on the other of said seat and said seat support and in rolling engagement with said first-named bearing surface.

18. A chair according to claim 12 further comprising bias means engaging the seat and urging the seat towards said rearward position.

19. A chair according to claim 12 wherein the seat support includes pivot mounting means permitting pivotal movement of the seat between a generally horizontal position and a generally vertical position.

20. A chair according to claim 5, wherein the connector portion of each leg member further includes a key-type formation matching the formations on the connector elements of the seat structure.

21. A chair according to claim 20, wherein the fastener means connects a back support and a leg member to the connector element at each side of the seat structure so that the leg members are adapted to be mounted rigidly on the seat structure in sandwiched relation or at the end of a connector portion of a respective back support and the back supports are adapted to be mounted rigidly on the seat structure in sandwiched relation or at the end of a connector portion of a respective leg member.

22. A chair according to claim 5, further comprising means mounting the back for limited pivotal movement independently of the seat between a substantially upright position and an inclined position.

23. A chair according to claim 1 wherein the seat support is a plate-like member, and wherein the plate-like member is mounted on the beam-like member for pivotal movement of the plate-like member generally about the axis of the beam-like member between a generally horizontal position and a generally vertical position.

24. A chair according to claim 23 wherein the plate-like member is generally U-shaped in plan, the base part of the "U" being generally coextensive with the beam-like member, the legs of the "U" being said portions of the seat support.

25. A chair according to claim 24 wherein the leg portions of the plate-like member are upwardly concavely curved and wherein the side portions of the seat engage and are supported by the leg portions, such side portions of the seat being downwardly convexly curved to match the leg portions of the plate-like member.

26. A chair according to claim 22 further comprising bias means engaging the back and urging the back towards said substantially upright position.

* * * * *